US011313652B1

(12) United States Patent
Burguess et al.

(10) Patent No.: US 11,313,652 B1
(45) Date of Patent: Apr. 26, 2022

(54) UNDERBODY KIT

(71) Applicant: Government of the United States, as represented by the Secretary of the Army, Washington, DC (US)

(72) Inventors: Victor Wilhelm Burguess, Royal Oak, MI (US); Shawn Christopher Klann, Warren, MI (US)

(73) Assignee: Government of the United States, as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/184,769

(22) Filed: Feb. 25, 2021

(51) Int. Cl.
*F41H 7/04* (2006.01)

(52) U.S. Cl.
CPC ..... *F41H 7/042* (2013.01)

(58) Field of Classification Search
CPC ..... F41H 5/007; F41H 7/042; F41H 7/044
See application file for complete search history.

(56) References Cited

U.S. PATENT DOCUMENTS

| | | | |
|---|---|---|---|
| 6,345,563 | B1 | 2/2002 | Middione et al. |
| 7,997,182 | B1 | 8/2011 | Cox |
| 9,207,046 | B1 | 12/2015 | Warren |
| 2003/0010189 | A1 | 1/2003 | Zonak |
| 2004/0159228 | A1 | 8/2004 | Budnik |
| 2006/0086243 | A1 | 4/2006 | Seo et al. |
| 2007/0017361 | A1 | 1/2007 | Zank et al. |
| 2011/0138994 | A1 | 6/2011 | Joynt et al. |
| 2011/0277621 | A1 | 11/2011 | Joynt |
| 2012/0000352 | A1 | 1/2012 | Warren |
| 2012/0174746 | A1 | 7/2012 | Mills et al. |
| 2012/0180642 | A1* | 7/2012 | Pavon ..... F41H 7/042 89/36.17 |
| 2012/0186428 | A1 | 7/2012 | Peer et al. |
| 2012/0210861 | A1 | 8/2012 | Tobie |
| 2012/0247315 | A1 | 10/2012 | Treadway et al. |
| 2012/0312607 | A1 | 12/2012 | Joynt et al. |
| 2013/0092016 | A1 | 4/2013 | Sales |
| 2013/0205981 | A1 | 8/2013 | Bayer et al. |
| 2013/0298753 | A1 | 11/2013 | Pavon |
| 2014/0013933 | A1 | 1/2014 | Capouellez |
| 2014/0318359 | A1 | 10/2014 | Asaf et al. |
| 2014/0318360 | A1 | 10/2014 | Peer et al. |
| 2015/0251616 | A1 | 9/2015 | Dobriski et al. |
| 2016/0159401 | A1 | 6/2016 | Batt |
| 2016/0377386 | A1 | 12/2016 | Svane et al. |
| 2018/0058820 | A1 | 3/2018 | Kwiatkowski et al. |

FOREIGN PATENT DOCUMENTS

| | | | |
|---|---|---|---|
| SE | 521535 | C2 | 11/2003 |
| WO | 0239048 | A2 | 5/2002 |
| WO | 2012052768 | A1 | 4/2012 |
| WO | 2014087174 | A1 | 6/2014 |

* cited by examiner

*Primary Examiner* — J. Woodrow Eldred

(57) ABSTRACT

An underbody kit for a vehicle having an outer body shell defining a cavity, at least one explosive device secured to the outer body shell within the cavity, and wherein the underbody kit is constructed and arranged to counteract both a blast event near the vehicle and a penetrator event.

20 Claims, 6 Drawing Sheets

UNDERBODY KIT

GOVERNMENT INTEREST

The inventions described herein may be made, used, and/or licensed by or for the U.S. Government. The Government has rights in the invention(s).

TECHNICAL FIELD

The field to which the disclosure generally relates to includes underbody kits which may be used to protect military vehicles from mine engagements.

BACKGROUND

Conventional armored vehicles attempt to moderate the effect of mines, explosive devices, and the like by using armor of a thickness that will not be penetrated by soil, rocks or the like, or by the blast from such a mine or another explosive device. When such vehicles detonate an anti-vehicle device below the vehicle, a penetrator and/or blast debris from the mine may be propelled upward. Much of the energy of the mine and any material propelled by it may hit the bottom surface of the vehicle. As a result, the energy of the material and the blast may be transferred to that surface and the probability that the armor bottom will be defeated and breached is increased. Additionally, the energy of the material and the blast being transferred to that surface may cause the vehicle itself to be propelled upward, and in some cases, leave the surface on which the vehicle runs. The thickness of armor that can be used to counteract underbody explosive devices, however, is limited because increasing the thickness of armor will add weight to the vehicle and decrease vehicle mobility.

Traditional theory suggests that the blast energy of a mine, specifically a shaped mine, may be directed upwards from the mine in a conical (or tapered) shape, widening, in some cases, as material is propelled upward. This column of sand or soil may be referred to as "soil ejecta." Based on the concept of a conical shaped upward blast, conventional mine-protected vehicles have been designed with a relatively higher ground clearance to allow more of the blast energy to dissipate in the space above the ground before encountering the bottom of the vehicle. However, this distance has little effect on penetrator style anti-tank mines as the threat is moving at such a high rate of speed that this increased distance provides little benefit. What is needed is a better way to protect vehicles from upward blasts and other types of projectiles that does not drastically increase the underbody thickness and in turn burden the vehicle with excess weight and reduced ground clearance that may affect vehicle mobility.

SUMMARY

The following presents a simplified summary of the disclosed subject matter to provide a basic understanding of some aspects of the various embodiments. This summary is not an extensive overview of the various embodiments. It is intended neither to identify key or critical elements of the various embodiments nor to delineate the scope of the various embodiments. Its sole purpose is to present some concepts of the disclosure in a streamlined form as a prelude to the more detailed description that is presented later.

A number of variations may include an underbody kit constructed and arranged to be attached to a vehicle that includes an outer body shell defining a cavity within the outer body shell which may provide an air gap within the outer body shell. In a number of variations, one or more explosive devices may be attached to the outer body shell within the cavity. The underbody kit may be constructed and arranged to counteract both: (1) a blast event near the vehicle (impulsive loading) and (2) a penetrator event including, but not limited to, an explosively formed projectile (EFP) event. In a number of variations, the shaped outer body shell may provide vertical space underneath the hull to mitigate a blast event, while the one or more explosive devices may be used to mitigate a penetrator event.

In a number of variations, the one or more explosive devices may be reactive armor explosive devices. In a number of variations, the one or more explosive devices may be arranged as an array of explosive devices and the array may be at least a two-by-two array of explosive devices. In other variations, the explosive devices may be arranged to explode in at least two different directions. In another variation, a first group of explosive devices may be positioned on a first side of a centerline and a second group of explosive devices may be positioned on a second side of the centerline. The first group of explosive devices may explode in a first direction and the second group of explosive devices may explode in a second direction, where the first direction is different than the second direction. The centerline may correspond to a centerline of the vehicle so that the centerline represents a lowest point beneath a hull of the vehicle when the underbody kit is attached to the vehicle. The center line may extend along the longitudinal axis of the vehicle and be central of the vehicle when facing the front of the vehicle.

In a number of variations, end plugs may be positioned at opposing ends of the outer body shell adjacent the cavity. In a number of variations, when the one or more explosive devices explode, the end plugs may each be pushed open from the outer body shell allowing for venting of the outer body shell. Venting may allow the outer body shell to remain intact and not blown down to meet the explosion.

In a number of variations, the outer body shell may be configured to overlap a portion of a vehicle hull which the outer body shell is to be attached to. The outer body shell may be constructed and arranged to be removeably attached to the vehicle in any number of variations including, but not limited to, mechanical fasteners such as bolts. In one variation, the portion of the outer body shell overlapping a portion of the hull may be bolted to the hull of the vehicle.

A number of variations may include a method of protecting a vehicle against both a blast event and a penetrator event. In a number of variations, the method may include providing an underbody kit constructed and arranged to be removeably attached to a vehicle including, but not limited to, a military vehicle, to protect the vehicle from a blast event located at or below the surface of a road, and a penetrator event. The underbody kit may include an outer body shell which may define a cavity within the outer body shell to provide an air gap. In a number of variations, one or more explosive devices may be attached to the outer body shell within the cavity. The shaped outer body shell may provide vertical space underneath the hull to mitigate a blast event, while the one or more explosive devices may be used to mitigate a penetrator event. In a number of variations, the underbody kit may be retroactively attached to the vehicle after the vehicle has been produced.

In a number of variations, the underbody kit may be attached to a lower portion of the hull of the vehicle so that the underbody kit may later be removed from the vehicle.

The underbody kit may be attached to the vehicle so that the underbody kit spans a length of a chamber of the vehicle adapted to contain occupants of the vehicle.

In a number of variations, the one or more explosive devices may be formed as an array of individual explosive devices. The array of individual explosive devices may contain a centerline with a first group of individual explosive devices located on a first side of the centerline and a second group of individual explosive devices located on a second side the centerline. The centerline may be associated with a lower ridge of the underbody kit. The lower ridge of the underbody kit may be a lower portion of the vehicle when the underbody kit is attached to the vehicle. The centerline may be positioned along the longitudinal axis of the vehicle and may be central of the vehicle when facing the front of the vehicle. The first group of individual explosive devices may be adapted to explode in a first direction and the second group of individual explosive devices may be adapted to explode in a second direction that is different than the first direction.

The following description and the annexed drawings set forth in detail certain illustrative aspects of the subject matter. However, these aspects are indicative of some of the numerous ways in which the principles of the subject matter can be employed. Other aspects, advantages, and novel features of the disclosed subject matter will become apparent from the following detailed description when considered in conjunction with the drawings. It will also be appreciated that the detailed description may include additional or alternative embodiments beyond those described in this summary.

BRIEF DESCRIPTION OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example embodiments and other example methods of various aspects of the invention. It will be appreciated that the illustrated element boundaries (e.g., boxes, groups of boxes, or other shapes) in the figures represent one example of the boundaries. One of ordinary skill in the art will appreciate that in some examples, one element may be designed as multiple elements or that multiple elements may be designed as one element. In some examples, an element shown as an internal component of another element may be implemented as an external component and vice versa. Furthermore, elements may not be drawn to scale.

DETAILED DESCRIPTION

Figure 1:
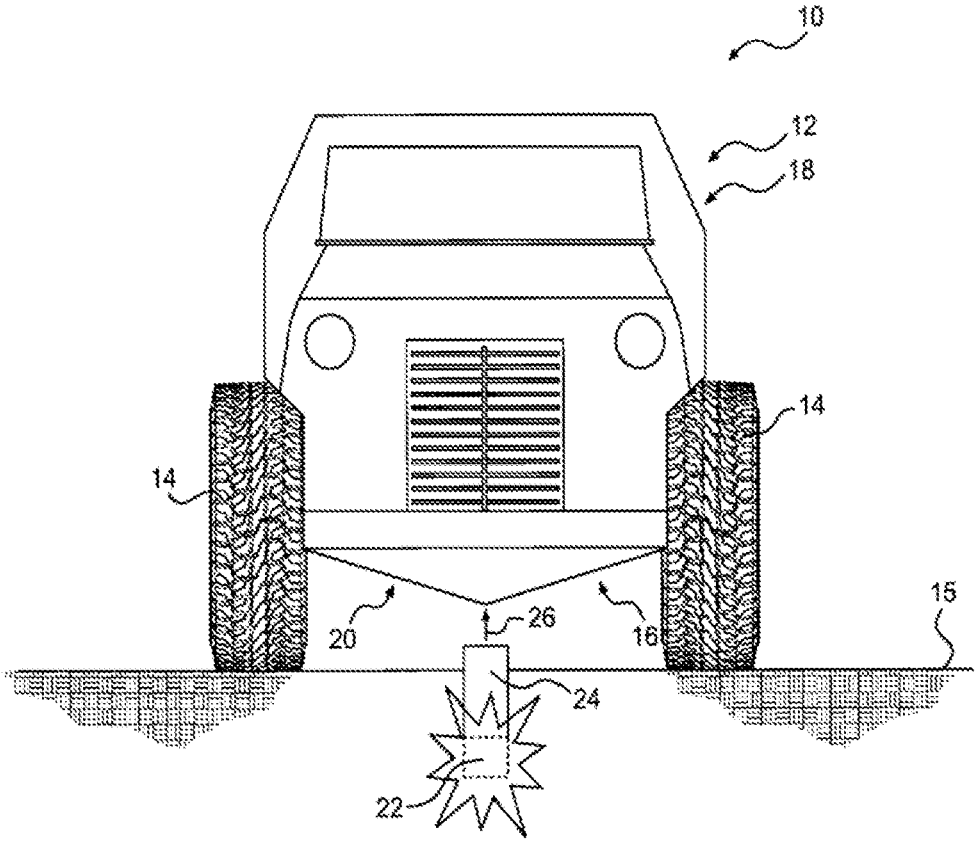
FIG. 1 illustrates an underbody kit attached to a vehicle according to a number of variations.

FIG. 1 illustrates a vehicle 10 that may be a high performance vehicle including, but not limited to, a military vehicle or the like. It is also contemplated that vehicle 10 may be any other vehicle including, but not limited to, a construction vehicle or a commercial vehicle. In a number of variations, a vehicle 10 may include a body 12 formed of plates including, but not limited to, steel plates. In a number of variations, the vehicle 10 may also include one or more wheels (wheel assemblies) or other traction devices 14 which may allow for movement of vehicle 10 over a surface 15.

In a number of variations, the body 12 of the vehicle 10 may include a hull 18 having one or more interior compartments including, but not limited to, a passenger compartment. The passenger compartment may be located at or near a central portion of the hull 18. In a number of variations, an underbody kit 20 may be attached to an underside of hull 18 which, when in the field may be adjacent to a surface 15 including, but not limited to, a ground surface. The underbody kit 20 may help to protect passengers and contents located within the compartments of the hull 18 from various threats, including, but not limited to, detonation of a mine 22 that may be located at or underneath the surface 15.

In a number of variations, as the vehicle 10 moves over the surface 15 in a vicinity of a mine 22, the presence or weight of the vehicle 10 may cause the mine 22 to detonate, yielding ejecta 24 that may be propelled toward the underbody kit 20 in an expected trajectory 26 that may be substantially vertical. In the case of a conventional mine, the ejecta 24 may be cylindrically- or conically-shaped ejecta including soil and/or other material that has been broken away from a substrate beneath the surface 15 by detonation forces of the mine 22. In another variation, the mine 22 may be a penetrator style threat where the ejecta 24 may be an explosively formed projectile (EFP), a shaped charge jet, etc. In a number of variations, the underbody kit 20 may protect the occupants of vehicle 10 from both conventional underbody mine blast and penetrator style threats.

FIGS. 2-6 illustrate a combined technology for both underbody blast events and EFP protection for a vehicle. The design of FIGS. 2-6 utilizes a lightweight complex shape underbody designed to provide vertical space from the ground and meet underbody blast requirements. This design also utilizes an integrated explosive device which may include, but is not limited to, a reactive armor solution inside of the underbody kit to provide underbody EFP protection. Advantageous features of this lightweight reactive underbody EFP Solution (L-RUES) design include: locations to mount reactive armor, environmental protection of the reactive armor, underbody blast mitigation, underbody EFP protection, robustness for durability loading, maintaining of vehicle durability, serviceability of the underbody solution, and serviceability of the explosive device solution including, but not limited to, a reactive armor solution.

Figure 2:
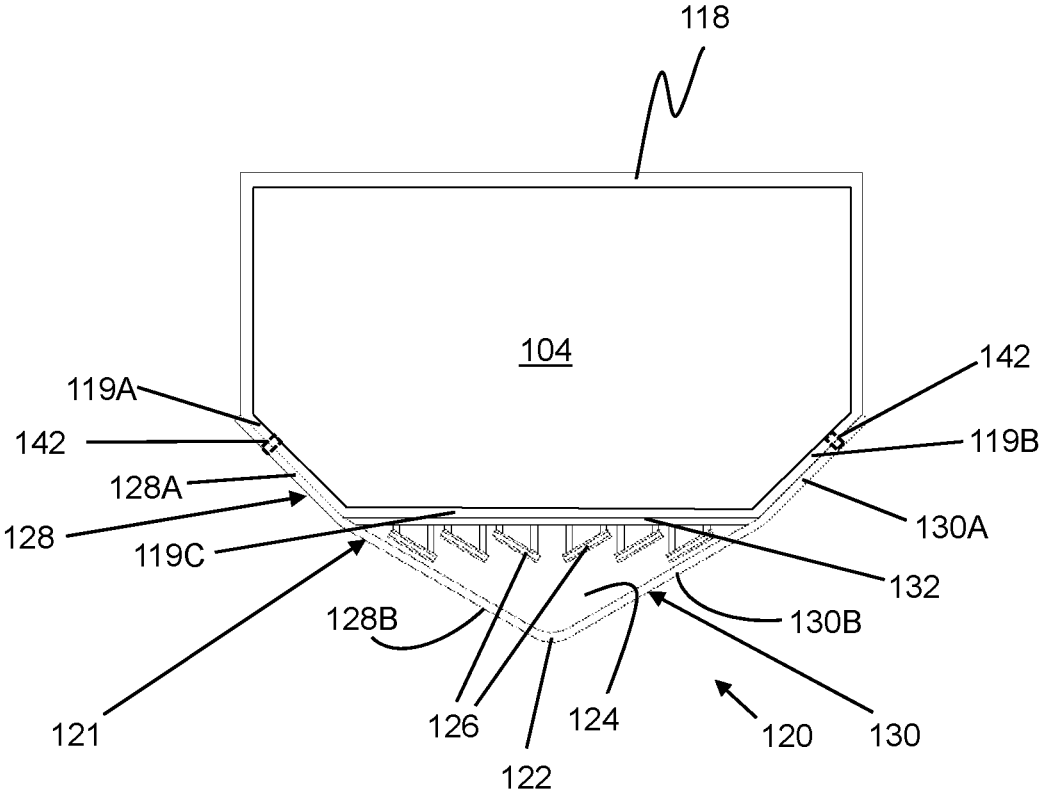
FIG. 2 illustrates a cross-sectional view of an underbody kit attached to a vehicle hull according to a number of variations.

FIG. 2 illustrates a cross-sectional view of an example embodiment of a reactive armor underbody kit 120 attached to the hull 118 of a vehicle, whereas FIGS. 3-6 illustrate the underbody kit 120 before it is attached to hull 118. In a number of variations, the vehicle hull 118 may include at least a first side wall 119A, a second side wall 1196, and a bottom wall 119C, which may in combination with other portions of hull 118 enclose a passenger compartment 104.

Figure 3:
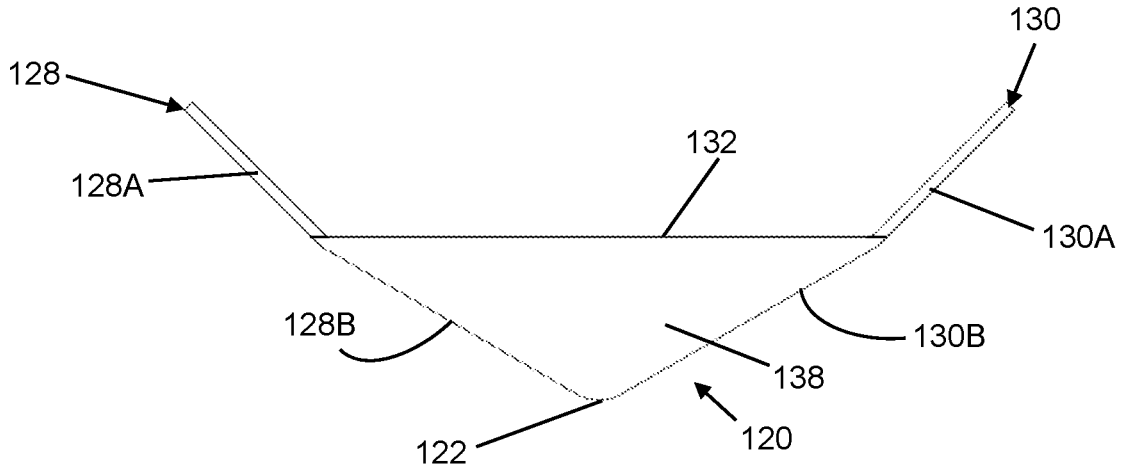
FIG. 3 illustrates a front view of an underbody kit according to a number of variations.
Figure 4:
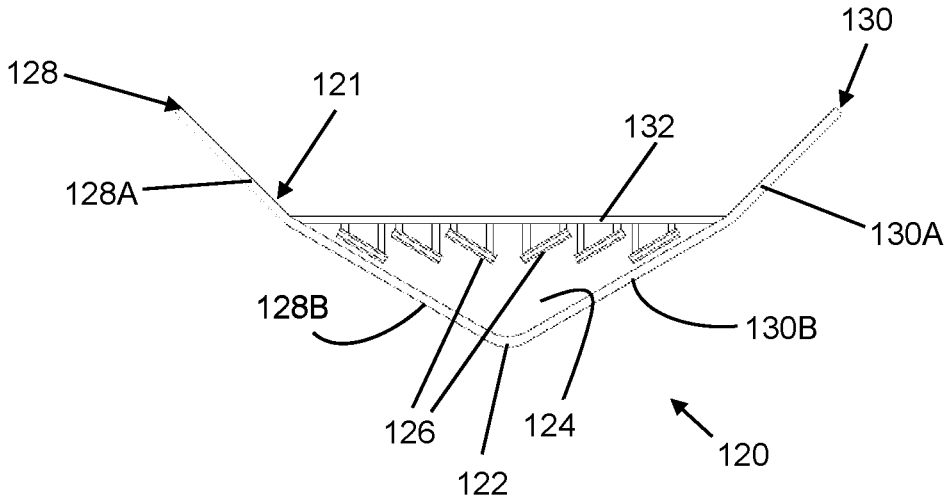
FIG. 4 illustrates a cross-sectional front view of an underbody kit according to a number of variations.
Figure 5:
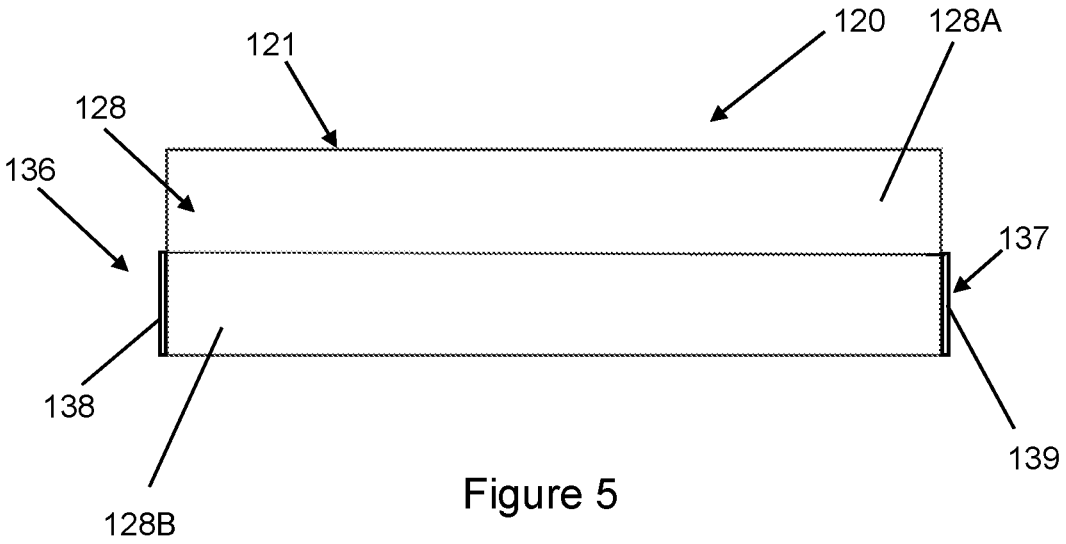
FIG. 5 illustrates a side view of an underbody kit according to a number of variations.
Figure 6:
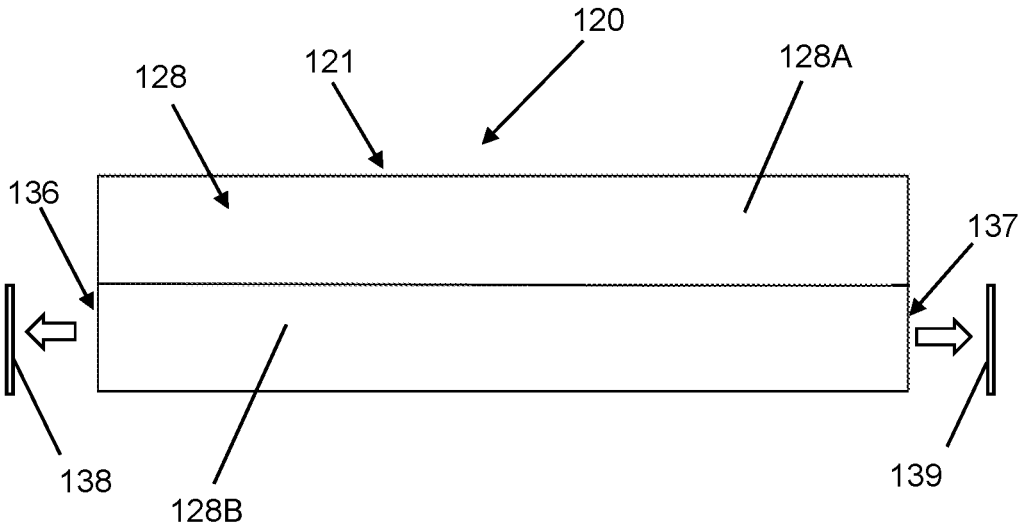
FIG. 6 illustrates a side view of an underbody kit with the end plugs popped out according to a number of variations.

Referring again to FIGS. 2-6, in a number of variations, the underbody kit 120 may include an outer body shell 121 comprising a first side wall 128 and a second side wall 130 symmetrically opposite of the first side wall 128 which meet at a first end 122 to form a "V-shape," a first end wall/end plug 138, and a second end wall/end plug 139 (best illustrated in FIGS. 3, 5 and 6). In a number of variations, the first side wall 128 may include a first portion 128A, a second portion 128B, wherein the first portion 128A and the second portion 128B may form an angle with each other. In a number of variations, the second side wall 130 may be symmetrically opposite of the first side wall 128 and may also include a first portion 130A and a second portion 1306, wherein the first portion 130A and the second portion 1306 form an angle with each other. In a number of variations, the first portion 128A of the first side wall 128 and the first portion 130A of the second side wall 130 may be constructed and arranged to contour a portion of the vehicle hull 118 geometry. In a number of variations, a top wall 132 may extend between the first side wall 128 and the second side wall 130 and may be positioned at a middle portion of each of the first side wall 128 and the second side wall 130. In a number of variations, the top wall 132 may act as a support for the outer body shell 121 as well as a mounting plate for explosive devices 126, as will be discussed hereafter. In a number of variations, the second portion 128B of the first side wall 128, the second portion 1306 of the second side wall 130, and the top wall 132 may define a cavity 124. In a number of variations, the cavity 124 may be triangular and may provide an air gap. In a number of variations, the shape of the outer body shell 121 and the vertical space formed by the cavity 124 may combat against underbody blast events by providing additional space between the blast and the hull 118 which may allow for the blast energy to further dissipate before encountering the bottom of the hull 118. Referring to FIGS. 3, 5, and 6, in a number of variations, the first end wall/end plug 138 may be secured to a first end 136 of the outer body shell 121 and the second end wall/end plug 139 may be secured to a second end 137 of the outer body shell 121. In a number of variations, the first and second walls/end plugs 138, 139 may be constructed and arranged to release from the outer body shell 121 to vent the outer body shell 121 cavity 124 in the event that the explosive devices 126 explode, a variation of which is illustrated in FIG. 6.

The outer body shell 121 may comprise any number of light weight, high strength materials including, but not limited to, steel, aluminum, and/or titanium. The material of the outer body shell 121 may be any number of thicknesses including, but not limited to, 1 inch.

The above description is for illustrative purposes only and it is noted that any number configurations of outer body shell designs may be used depending on the vehicle application.

Referring again to FIG. 4, in a number of variations, the explosive devices including, but not limited to, reactive armor 126 may be attached to the top wall 132 of the outer body shell via one or more mechanical fasteners including, but not limited to, one or more bolts.

In a number of variations, the outer body shell 121 may provide environmental protection for the explosive devices 126. In a number of variations, the outer body shell 121 may be constructed and arranged to allow a penetrator, including, but not limited to, an explosively formed penetrator, to pass through the outer body shell 121 and strike the explosive devices 126. The explosive devices 126 may then detonate upon impact from the penetrator counteracting the penetrator pieces. Accordingly, the explosive device 126 system may be passive such that it does not require a control system.

In a particular embodiment, the explosive device 126 may be a two-dimensional array of reactive armor tiles with each tile extending downward from the top wall 132. Other types of reactive armor may be installed within the underbody kit 120 as understood by those of ordinary skill in this art.

Figure 7:
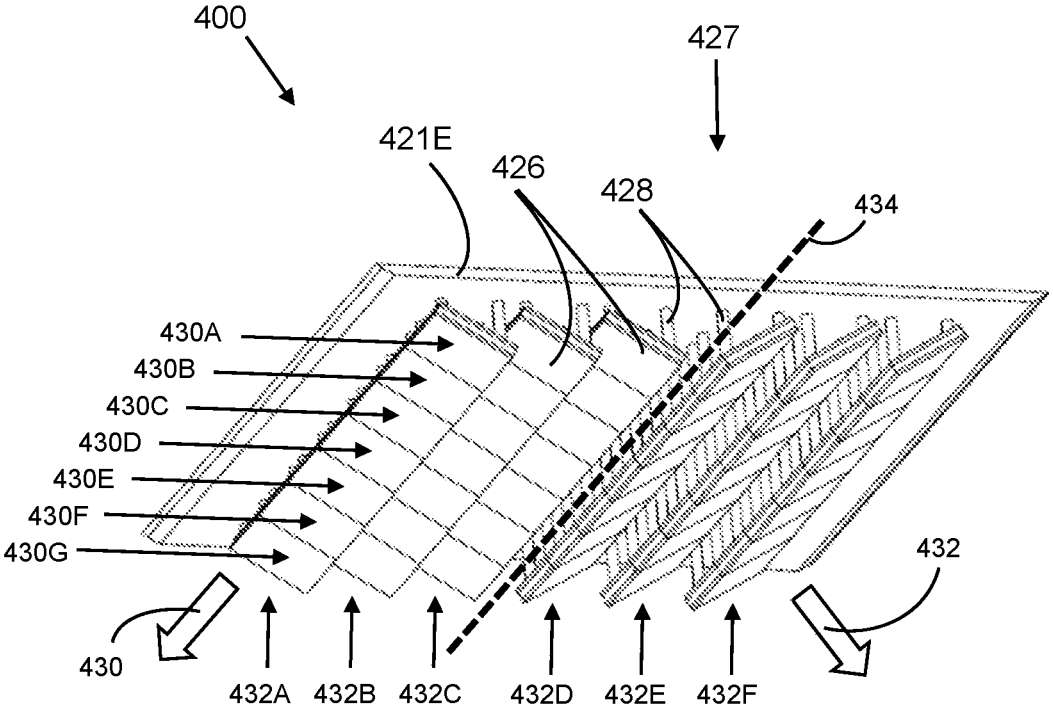
FIG. 7 illustrates a perspective view of an array of tiles of reactive armor according to a number of variations.

FIG. 7 illustrates a perspective view of one exemplary embodiment of a reactive armor sub-assembly 400 of an underbody kit. Sub-assembly 400 includes a wall 421E having an array of tiles of reactive armor 427 thereon. The array is composed of rows and columns of individual tiles of reactive armor 426. This example of an array of reactive tiles 427 includes seven rows 430A-G and six columns 432A-F of reactive armor tiles 426. Thus, this array consists of 7×6=42 reactive tiles 426. Other embodiments may consist of more or less reactive armor elements/tiles in each row and/or in each column as understood by those of ordinary skill in the art.

Each reactive armor tile 426 (or other explosive device) may be mounted at an angle relative to the bottom surface of wall 421E so that, for example, they may explode generally in the direction of the left arrow 430 or the right arrow 432. In some embodiments, the reactive armor tiles may be aimed in two different directions on opposite sides of a centerline 434 that may correspond to a centerline along the longitudinal axis of a military vehicle.

Some embodiments may use mounting devices 428 to mount each reactive armor tile 426 to the bottom of wall 421E. The mounting device 428 may be any appropriate device as understood by those of ordinary skill in the art. The mounting device may be solid device 428 or they may be devices that provide for air gaps between the reactive armor tiles 426 and the top wall 421E of the reactive armor underbody kit. In the present embodiment, the tiles 426 are mounted to the bottom surface of wall 421E using short and long stand-offs 436 and 438, respectively, to achieve the desired orientation.

In this example embodiment, columns 432A-C explode toward the left of the centerline 434 generally in the direction of arrow 430 and columns 432D-F explode toward the right of the centerline 434 generally in the direction of arrow 432. Being able to aim the reactive armor tiles 426 in one, two or more directions may aid in the reactive armor 426 to counter explosively formed projectiles (EFPs).

In this embodiment, wall 421E has a generally flat front edge 440 and rear edge 442 but has beveled left and right side edges 444 and 446, respectively. Here, each of the left and right side edges 444 and 446 include a plurality of bevels 448 and 450 such that the side edges 444 and 446 can be readily aligned with the inner surfaces sidewalls 128A and 128B and sidewalls 130A and 130B respectively when subassembly 400 is placed within the outer body shell 121, a variation of which is illustrated in FIG. 4. More specifically, the multi-angled sidewalls of the outer body shell 121 serve to align and support sub-assembly 400 when sub-assembly 400 is placed within the cavity 124 of the outer body shell 121. Sub-assembly 400 can be affixed to the top wall 132 of the outer body shell 121 using a plurality of fasteners (e.g., bolts, etc.) passed therebetween. Embodiments where sub-assembly 400 is removable from the outer body shell 121 provides advantages, because the reactive armor array may be reconfigured depending on the specific types of threats likely to be encountered in theatre, the reactive armor may also be inspected and serviced, etc.

Referring to FIG. 6, in a number of variations, upon detonation of the reactive armor tiles 126, the end plugs 139 may be pushed open from the outer body shell 121 allowing for venting of the cavity 124. This may allow the underbody kit 120 to remain intact and attached to the vehicle and not blown down to meet the explosion.

Referring to FIG. 2, in a number of variations, the underbody kit 120 may be attached to the hull 118 so that it may be removable from the hull 118 of the vehicle. In one variation, the underbody kit 120 may be attached to the hull 118 of the vehicle by attaching the first portion 128A of the first side wall 128 to the first side wall 119A of the vehicle hull 118 by at least one mechanical fastener 142 including, but not limited to, a bolt, and by attaching the first portion 130A of the second side wall 130 to the second side wall 119B of the hull 118 of the vehicle by at least one mechanical fastener 142 including, but not limited to, a bolt. In other embodiments, the underbody kit 120 may be attached to a vehicle with other fasteners and in other ways.

Figure 8:
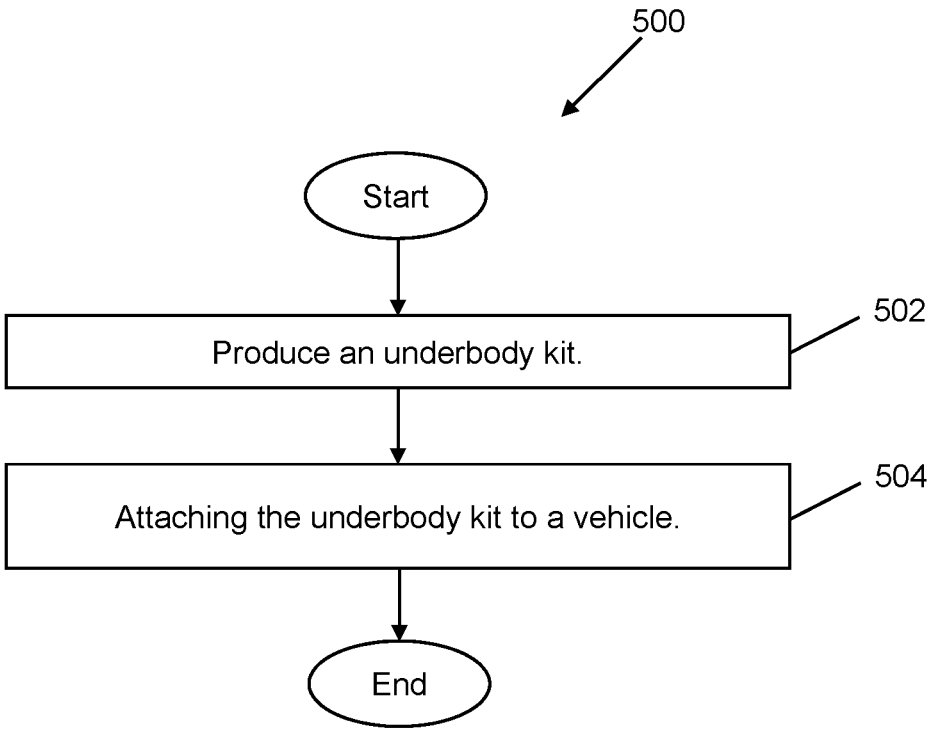
FIG. 8 illustrates a method of using an underbody kit according to a number of variations.

Methods that may be implemented in accordance with the disclosed subject matter, may be at least partially implemented with reference to FIG. 8. While, for purposes of simplicity of explanation, the methods are shown and described as a series of blocks, it is to be understood and appreciated that the disclosed aspects are not limited by the number or order of blocks, as some blocks can occur in different orders and/or at substantially the same time with other blocks from what is depicted and described herein. Moreover, not all illustrated blocks can be required to implement the disclosed methods. It is to be appreciated that the functionality associated with the blocks can be implemented by software, hardware, a combination thereof, or any other suitable means (e.g. device, system, process, component, and so forth). Additionally, it should be further appreciated that in some embodiments the disclosed methods are capable of being stored on an article of manufacture to facilitate transporting and transferring such methods to various devices. Those skilled in the art will understand and appreciate that the methods could alternatively be represented as a series of interrelated states or events, such as in a state diagram.

FIG. 8 illustrates some example actions of a method 500 of protecting a vehicle against both pure blast events and/or penetrator style threats such as explosively formed projectiles. The method 500 begins, at 502, by producing an underbody kit that is formed to be attached to a vehicle such as a military vehicle to protect the vehicle from a blast event located at or below the surface of a road, path, and the like, and a penetrator event. In a number of variations, the underbody kit may mitigate both a blast event and/or a penetrator event using a light weight design. In a number of variations, the shape of the outer body shell of the underbody kit may provide for vertical space underneath the hull which may protect the hull from a blast event by allowing the blast energy to dissipate in the space before encountering the bottom of the vehicle. In the event of a penetrator event, a penetrator may pass through the outer body shell into the cavity and strike the explosive devices. Upon impact from the penetrator, the explosive devices may detonate creating counteracting forces to reduce the effect the penetrator on the vehicle.

The underbody kit may be attached to the vehicle, at 504. In the preferred embodiment, the underbody kit is attached to the vehicle after the vehicle has been produced. As discussed above, the underbody kit may be bolted or attached to the vehicle with other types of fasteners. In some configurations, the underbody kit may span a length of the vehicle under which occupants of the vehicle are contained in an effort to protect their lives. Thus, the underbody kit would be installed beneath the hull of a vehicle to counteract improvised explosive devices to protect the occupants within a vehicle.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims. Accordingly, the disclosure is intended to embrace all such alterations, modifications, and variations that fall within the scope of this application, including the appended claims.

Moreover, the description and illustration of the invention is an example and the invention is not limited to the exact details shown or described. References to "the preferred embodiment", "an embodiment", "one example", "an example" and so on, indicate that the embodiment(s) or example(s) so described may include a particular feature, structure, characteristic, property, element, or limitation, but that not every embodiment or example necessarily includes that particular feature, structure, characteristic, property, element, or limitation. Additionally, references to "the preferred embodiment", "an embodiment", "one example", "an example" and the like, are not to be construed as preferred or advantageous over other embodiments or designs. Rather, use of the words "the preferred embodiment", "an embodiment", "one example", "an example" and the like are intended to present concepts in a concrete fashion.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics can be combined in any suitable manner in one or more embodiments.

What is claimed is:

1. An underbody kit for a vehicle comprising:

an outer body shell, wherein the outer body shell includes a cavity defined within the outer body shell;

at least one explosive device secured to the outer body shell within the cavity; and wherein the cavity is constructed and arranged to provide a vertical space for energy from a blast to dissipate before encountering a hull of a vehicle to counteract a blast event and the at least one explosive device is passive and is constructed and arranged to detonate upon impact from a penetrator to counteract a penetrator event.

2. The underbody kit of claim 1 wherein the outer body shell comprises a first side wall, a second side wall, wherein the first side wall and the second side wall meet at a first end, a top wall attached to each of the first side wall and the second side wall, a first end plug secured to the first side wall, the second side wall, and the top wall, and a second end plug positioned opposite of the first end plug and secured to the first side wall, the second side wall, and the top wall, wherein the first end plug and the second end plug are constructed and arranged so that when the at least one explosive device explodes, the first end plug and the second end plug are pushed from the remaining outer body shell to open and vent the outer body shell.

3. The underbody kit of claim 1 wherein the at least one explosive device comprises a plurality of reactive armor explosive devices.

4. The underbody kit of claim 1 wherein the at least one explosive device is arranged as an array of explosive devices.

5. The underbody kit of claim 3 wherein the plurality of reactive armor explosive devices are arranged to explode in at least two different directions.

6. The underbody kit of claim 3 wherein the array is at least a two-by-two array of the reactive armor explosive devices.

7. The underbody kit of claim 1 wherein the at least one explosive device comprise a first group of explosive devices positioned on a first side of a centerline and a second group of explosive devices positioned on a second side of the centerline; wherein the first group of explosive devices is configured to explode in a first direction and the second group of explosive devices is configured to explode in a second direction; and wherein the first direction is different than the second direction.

8. The underbody kit of claim 1 wherein the centerline corresponds to a centerline of the vehicle along a longitudinal axis of the vehicle.

9. The underbody kit of claim 1 wherein the outer body shell comprises at least one of steel, aluminum, or titanium.

10. The underbody kit of claim 1 wherein the outer body shell is configured to be attached to the vehicle by at least one mechanical fastener.

11. The underbody kit of claim 1 wherein the underbody kit is constructed and arranged to span a length of a passenger compartment of the vehicle.

12. The underbody kit of claim 1 wherein the underbody kit is constructed and arranged to be removeable from the vehicle.

13. A method of protecting a vehicle against both a blast event and a penetrator event comprising:

producing an underbody kit, wherein the underbody kit includes an outer body shell defining a cavity within the outer body shell and at least one explosive devices disposed within the cavity and secured to the outer body shell; wherein the outer body shell provides a space for energy from a blast to dissipate before encountering a hull of a vehicle to protect the vehicle from the blast event and the at least one explosive device is passive and detonates upon impact from a penetrator to counteract the penetrator to protect the vehicle from the penetrator event; and attaching the underbody kit to the vehicle.

14. The method of claim 13 further comprising venting of the outer body shell when the at least one explosive device explodes by opening of a first end plug and a second end plug.

15. The method of claim 13 further comprising:

removing the underbody kit for servicing and reattaching the underbody kit to the vehicle.

16. The method of claim 13 further comprising:

attaching the underbody kit to the vehicle so that the underbody kit spans a length of a passenger compartment of the vehicle.

17. The method of claim 13 wherein the at least one explosive device is formed as an array of individual explosive devices.

18. The method of claim 17 wherein the array of individual explosive devices contains a centerline with a first group of individual explosive devices located on a first side of the centerline and a second group of individual explosive devices located on a second side of the centerline, and wherein the centerline corresponds to a centerline of the vehicle along a longitudinal axis of the vehicle.

19. The method of claim 18 wherein the first group of individual explosive devices are constructed and arranged to explode in a first direction and the second group of individual explosive devices are constructed and arranged to explode in a second direction that is different than the first direction.

20. An underbody kit for a vehicle comprising:

an outer body shell, wherein the outer body shell defines an internal cavity;

at least one explosive device secured to the outer body shell within the internal cavity;

a first end cap secured to a first end of the outer body shell and a second end cap secured to a second end of the outer body shell;

wherein the underbody kit is constructed and arranged so that energy from a blast event is dissipated in the internal cavity before reaching a hull of a vehicle during a blast event, and the at least one explosive device detonates upon impact from a penetrator that passes through the outer body shell during a penetrator event, and wherein the first end cap and the second end cap are pushed from the outer body shell upon detonation of the at least one explosive device, venting the outer body shell so that the outer body shell remains attached to the vehicle during the penetrator event.

* * * * *